United States Patent [19]

Hyder

[11] 4,110,988

[45] Sep. 5, 1978

[54] METHOD FOR FORMING DOMES FROM SUBTERRANEAN DIAPIRIC MATERIAL

[76] Inventor: Charles L. Hyder, 1007 Acequia Trail, Albuquerque, N. Mex. 87107

[21] Appl. No.: 844,626

[22] Filed: Oct. 25, 1977

[51] Int. Cl.[2] ..... E02D 27/28

[52] U.S. Cl. ..... 405/131; 166/272; 166/305 D

[58] Field of Search ..... 61/36 A, 35, 0.5; 166/305 D, 272, 248

[56] References Cited

U.S. PATENT DOCUMENTS

| | | | |
|---|---|---|---|
| 2,548,059 | 4/1951 | Ramsey | 166/305 D |
| 3,986,557 | 10/1976 | Striegler | 166/272 |
| 4,008,762 | 2/1977 | Fisher et al. | 166/248 |

*Primary Examiner*—Jacob Shapiro
*Attorney, Agent, or Firm*—Walter R. Keller

[57] ABSTRACT

A method for forming domes from subterranian diapiric material, especially salt to facilitate the genesis and extraction of oil therefrom, and therearound, characterized by the following process. First, a series of continuous wellbores having vertical first section in the area in which is desired to create the dome, penetrating the overburden layer to near the layer of diapiric material is drilled and a second section thereof contained in the salt formation and a third section thereof rising vertically from the distal end of the second section to the ground surface, is formed. Each of the wellbores is arranged with respect to the others so that the second sections emanate from the desired dome area in a radial-like pattern. Next, a steel well casing sealed at all joints and connections when complete, is inserted into each of the wellbores extending the entire length thereof. Thereafter, a heating fluid is circulated through the wellbores, heating the diapiric material and overburden layer, thereby reducing the effective viscosity of the diapiric material rendering it mobile. Subsequently the subterranean pressures cause the less viscous diapiric material to flow into the area of the desired dome and to rise toward the surface of the earth in the desired dome area.

2 Claims, 4 Drawing Figures

METHOD FOR FORMING DOMES FROM SUBTERRANEAN DIAPIRIC MATERIAL

BACKGROUND

1. Field of the Invention

This invention relates primarily to the creation of domes and development of oil and gas pools and oil and gas fields.

2. Description of the Prior Art

There is no prior art specifically directed toward the synthesizing of domes of diapiric material. The application of heat to subterranean layers of diapiric material to form domes has not been disclosed in any known prior art. Nature has over the course of billions of years created salt-domes, the geological theories of which are similar to the basic scientific foundation of the present invention. The application of heat to known deposits of tar sands to reduce the viscosity of the bitumen therein has been known and was disclosed in Striegler et al, U.S. Pat. No. 3,986,557. The patterning of wells to efficiently utilized the heat pumped into subterranean strata, for a different purpose, was disclosed by Salmonson U.S. Pat. No. 2,914,309. However, neither the pattern, purpose, or result of the patterning of Salmonson is related to the production or utility of synthetic domes.

In the present invention, the use of heat, the method of applying heat, and the patterning of the wells are all directed toward the synthesis domes of diapiric materials.

SUMMARY

The present invention relates to the synthesis of a dome of diapiric materials to facilitate the genesis and extraction of oil and gas from oil and gas and organic bearing subterranean strata. Nature, over a period of billions of years, in certain geological areas has created salt-domes which have greatly facilitated in the extraction of oil from oil bearing strata. Notable are the Spindle Top Dome which has a total yield plus known reserves of approximately 400 million barrels and the Conro Dome which has a yield plus known reserves of 700 million barrels of oil. An average yield per salt-dome has been estimated to be approximately 100 million barrels. The salt-dome is basically caused by an intrusion of hot less viscous, and pressurized salt being forced by gravitational and geological pressures to the surface through the overburden material, causing deformation of the adjacent and overlying layers of the earth, while at the same time relaxing the gravitational stresses of the geological inversion. The strata around a salt-dome then become bent upward forming convenient pockets or traps in which oil, after being also heated and squeezed out by the internal pressures of the compaction of the formation, may collect.

Throughout the world the location of extensive salt beds approximately coincides geographically with large deposits of oil and tar bearing formation, and large deposits of coal. However, at present the generation and extraction of a vast portion of the newly generated and available oil has been economically infeasible, since most of the oil is not pooled. It is an objective of this invention to create a synthetic dome thus making economically feasible and generation and extraction of the oil which is not now economically extractable, thus increasing the potential world oil reserves by a factor of 2 to 1,000.

The creation of a synthetic dome can be achieved by heating a bed of diapiric material making it an objective of this invention to provide a method for applying heat to a large volume of subterranean diapiric material formation, to synthesize such a dome.

Creation of a dome will enable geologists to study subterranian dynamics and oil genesis and migration. It is therefore an objective of the invention to provide geologists with a research tool.

It has been found that the edge of the peripheral area is a possible source of another dome. Thus, proper patterning of the direct synthetic domes, enhances the probability of synergistic domes being created, thereby increasing the cost effectiveness of the development of an entire oil field.

DESCRIPTION OF THE PREFERRED EMBODIMENT

Figure 1:
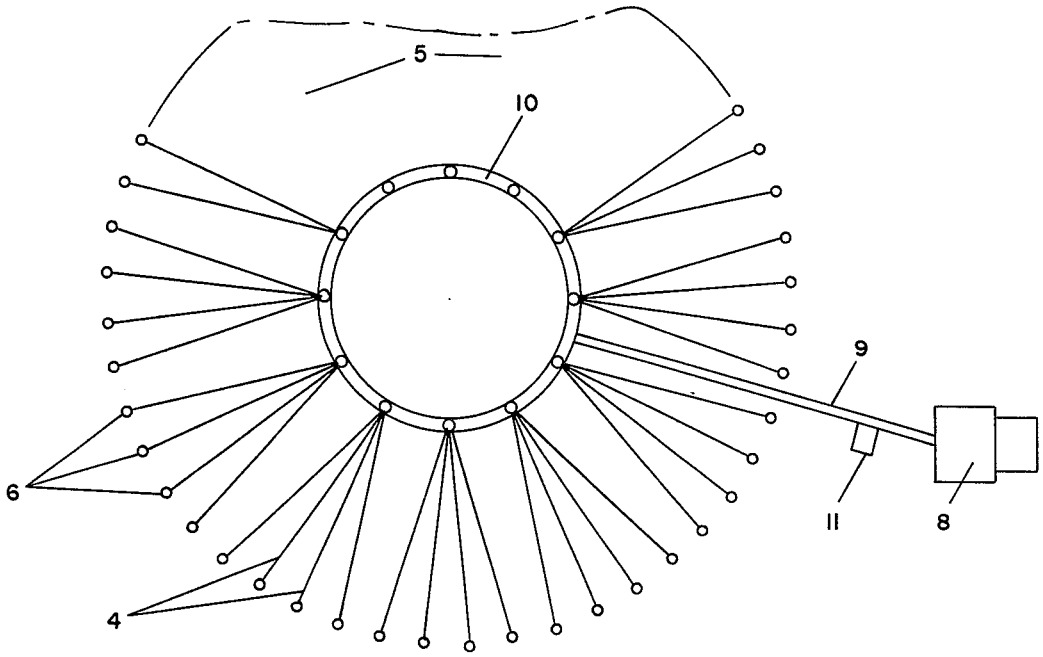
FIG. 1 is a plan view of the invention.
Figure 2:
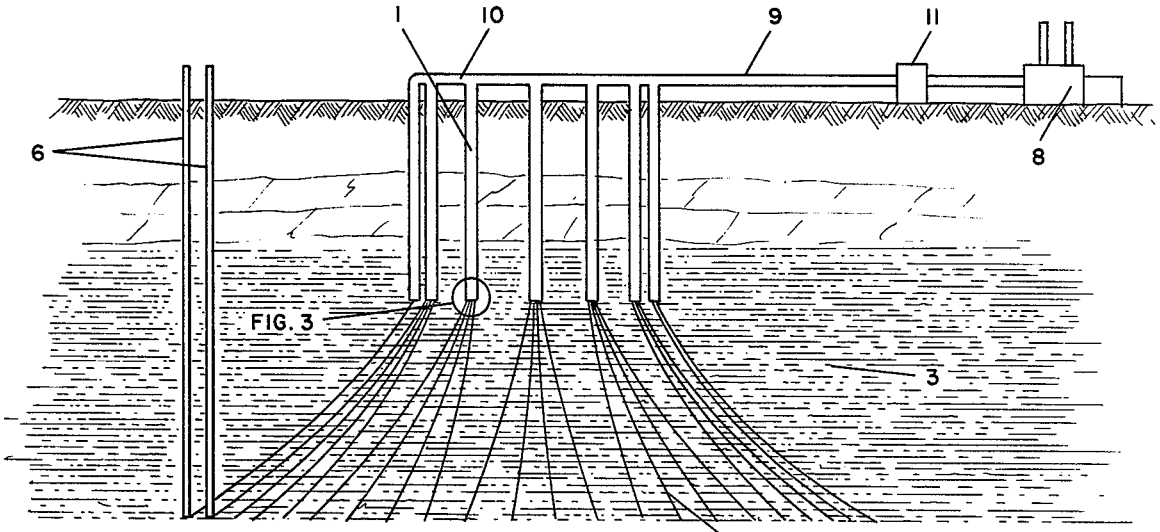
FIG. 2 is a vertical view of the invention.
Figure 3:
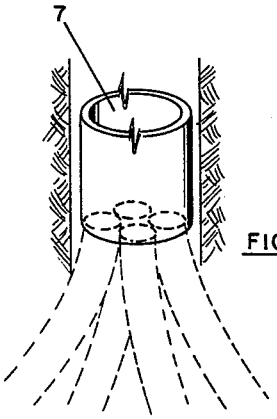
FIG. 3 is an enlarged view of the detail shown on FIG. 2.

Referring, to drawings FIG. 1 and FIG. 2, the invention is shown to have a plurality of continuous wellbores having vertical section 1 drilled by conventional means in the desired dome area 2 from the earth's surface to the layer of salt 3. For the purposes of the preferred embodiment the diapiric material shall be referred to as salt, however, layers of other diapiric materials are equally within the scope of this invention. The vertical sections 1, are relatively large, on the order of twelve inches. Second sections 4 of the wellbores are drilled in a pattern radiating outwardly from the desired dome area 2 in to what is designed peripheral area 5. The second sections 4 are drilled in a manner curving away from the vertical, yet remaining in the salt layer 3. The second sections 4, of the wellbores are a narrower diameter, on the order of four inches, and two or more second sections 4 emanate from each vertical section 1 as shown in FIG. 3. The number of second sections 4 will naturally depend on the geological circumstances, topographical considerations, and size of a heat generating plant 8 to be employed. In general, the diameter of the desired salt-dome area 2 will be on the order of one mile, and the diameter of the peripheral area 5 on the order of three miles. At the distal end of each second section 4, a connecting exhaust section 6 is drilled vertically from the ground surface. The diameter of the exhaust sections 6 are relatively large to reduce back pressure on the system. Each section 1,4,6 of the wellbores is lined with a casing 7. The casing 7 must be a relatively good heat conductor, and have the strength to withstand the severe subterranean pressures. All connections and joints in the casing 7 must be sealed to prevent salt from intruding in to the system and clogging it. Having thus emplaced the heat distribution system the heat plant 8 has a connection to the first section 1 of the wellbores by means of a large, very well insulated, heat fluid transmission pipe 9 and a manifold pipe 10. The heat plant 8 provides heating fluid which is pumped through the transmission pipe 9, the manifold pipe 10, and into the large vertical first sections 1, so that the area of the desired as salt-dome 2 is sufficiently heated. The heat fluid then passes through the second sections 4 of the well casing heating the peripheral area 5, and the heat fluid is then exhausted out the vertical exhaust sections 6. If the heat plant 8 is coal fired, the combustion exhaust gasses themselves could be the heating fluid. But in the event some other source is used to power the heat plant 8 for example, solar, other heat fluids could be used, and it is realized that a closed system heat transfer loops conserving the heat transfer fluid could be used if desired. It becomes important to regulate the temperature of the heat fluid, so that the salt in the peripheral area 5 and the desired dome area 2 does not immediately melt and begin flow only adjacent to the second 4 and first sections 1 of the wellbores. A slower gradual heating to more nearly increase the temperature of the salt in the whole peripheral areas 5 and desired dome area 2 is preferred to get uniform flow. To accomplish this temperature control a temperature control mechanism 11 is inserted in the transmission pipe 9. If the heat fluid is exhaust gases of a coal fired heat plant, this could be a thermostatically controlled ambient air intake pump of standard construction to insert cool ambient air into the heating fluid. If another heat fluid is used other control means such as expansion chambers or insertion of cooling fluid may be used. When the temperature of the desired dome area 2 and the peripheral area 5 is raised sufficiently, the salt becomes less viscous, and expands, thereby increasing its pressure, and the salt begins to flow along the path of greatest mobility and least resistance creating a salt-dome.

The diameter and length of the continuous wellbores is not critical and will be determined by conventional drilling criteria, thermodynamic analysis for each in situ application, and economics of a given situation. The number of wellbores and the number of second sections 4 emanating from the area of the desired salt-dome 2 will also be determined by the same criteria.

Figure 4:
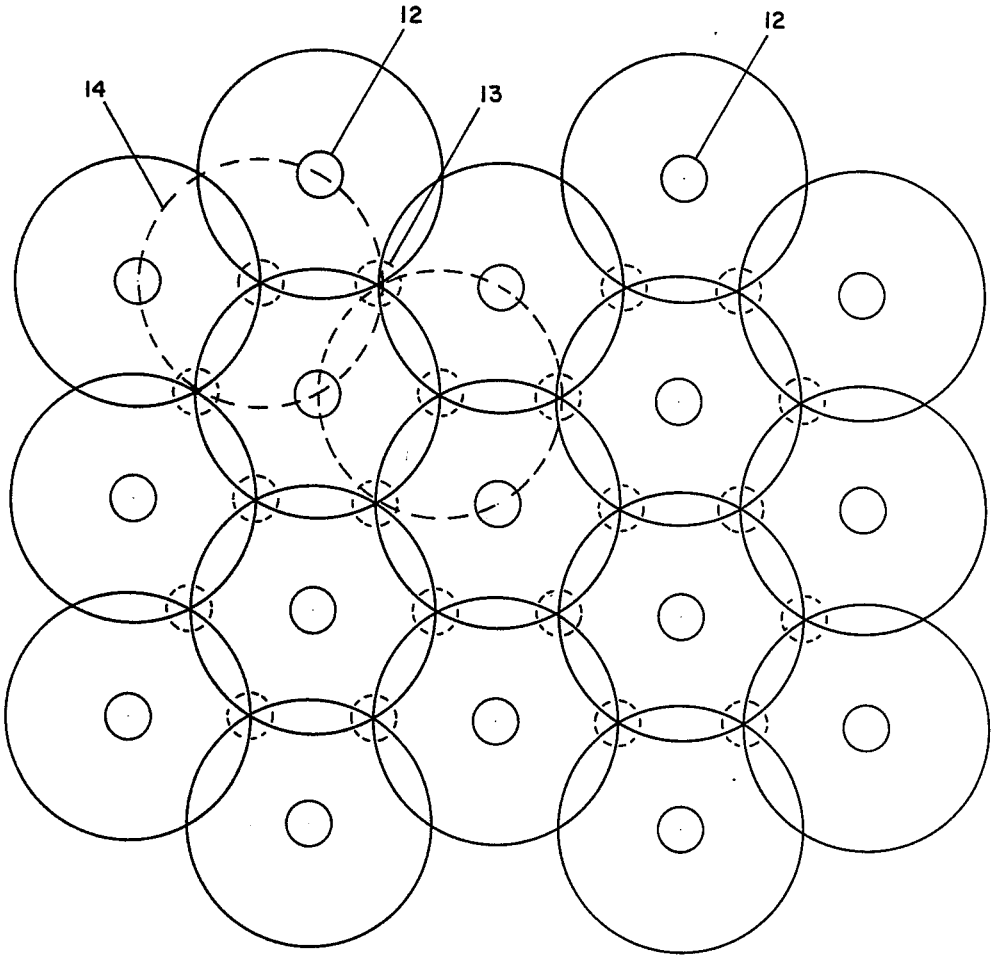
FIG. 4 is a plan view of the patterning of the domes.

Having thus described the method of synthesizing salt-domes 12, FIG. 4 shows patterning of numerous synthetic salt-domes 12 in oil field generation. synergistic effects of the synthesized salt-domes 12 may cause the creation of other salt-domes, designated passive domes 13. The passive domes 13 are created by the nearly uniform heating in its peripheral areas 14 by two or three direct synthetic salt-domes 12, and the concentration of heat at the points of intersection 13 of the peripheral area 5 of the direct synthetic salt-domes 12. Thus, in the development of an entire oil field patterning of the direct synthetic salt-domes 12, can increase the total number salt-domes generated and the yield of the field.

I claim:

1. Method for forming synthetic domes from subterranean diapiric material, especially salt which comprises: drilling a series of continuous wellbores, each having a first section drilled vertically from the ground surface to a depth wherein underlying subterranean strata of diapiric material is penetrated; and one or more second sections connected to each first section, said second sections emanating radially from the area of the desired dome and said second section gradually curving downward and outward from the first section in the strata of diapiric material; and a vertical exhaust section connecting the distal end of each second section to the surface; inserting sealed well casing within said wellbores and circulating a heating fluid through the well casing transferring heat to the strata of diapiric material thereby reducing the viscosity of the diapiric material increasing the pressure in the diapiric material, thereby rendering the diapiric material mobile and causing it to flow to create a dome.

2. The method of claim 1 wherein multiple domes are directly created in a pattern so that the area of heated diapiric material from two or more synthetic domes overlap increasing the probability that other domes will be created at the points of overlap through synergistic effects thus developing a field of domes and a corresponding oil field.

* * * * *